US006003785A

United States Patent [19]

Duey

[11] Patent Number: 6,003,785

[45] Date of Patent: Dec. 21, 1999

[54] COMPOSITE MATERIAL BELL CUP

[75] Inventor: David J. Duey, Orion, Mich.

[73] Assignee: Sames Electrostatic, Inc., Livonia, Mich.

[21] Appl. No.: 09/085,589

[22] Filed: May 27, 1998

Related U.S. Application Data

[60] Provisional application No. 60/047,764, May 27, 1997.

[51] Int. Cl.[6] ..... B05B 3/10; B05B 17/00; B05B 1/00

[52] U.S. Cl. ..... 239/223; 239/703; 239/591; 239/DIG. 19

[58] Field of Search ..... 239/223, 224, 239/700, 701, 702, 703, 704, 214.25, 706, 591

[56] References Cited

U.S. PATENT DOCUMENTS

| | | | |
|---|---|---|---|
| 3,072,341 | 1/1963 | Point et al. | 239/224 |
| 4,456,444 | 6/1984 | Patterson, II | 425/8 |
| 4,735,360 | 4/1988 | Kirchner et al. | 239/705 |
| 4,936,510 | 6/1990 | Weinstein | 239/223 |
| 5,820,036 | 10/1998 | Saito | 239/703 |
| 5,897,060 | 4/1999 | Kon et al. | 239/703 |

*Primary Examiner*—Andres Kashnikow
*Assistant Examiner*—Davis Hwu
*Attorney, Agent, or Firm*—Charles W. Chandler

[57] ABSTRACT

A rotary atomizing cup has an internal concave opening and a distributor member disposed in said opening for passing particles through the distributor member to an atomizing ring as the cup is being rotated. The distributor member is formed of a polymer material, the cup body of aluminum and the atomizing ring of stainless steel.

9 Claims, 1 Drawing Sheet

COMPOSITE MATERIAL BELL CUP

CROSS-REFERENCE TO RELATED APPLICATION

This application is a continuation-in-part of Provisional Application Ser. No. 60/047,764 filed on May 27, 1997 for "Composite Material Bell Cup".

BACKGROUND AND SUMMARY OF THE INVENTION

This invention relates to a multi-material electrostatic spray bell cup for atomizing a coating material. The cup is connected to a high voltage source and rotated at several thousand revolutions per minute to deliver atomized particles of the coating material such as paint, varnish, and the like to an oppositely charged target structure.

The general profile of the cup is well known in the art, and includes a front distributor with a peripheral, ring-shaped atomizing surface. The distributor has a circular array of small radial channels at its periphery. The channels discharge the coating material onto the atomizer ring.

A similar cup structure may be found in U.S. Pat. No. 4,936,510 which was issued Jun. 26, 1990, to Richard Weinstein for "Rotary Atomizer with Air Cap and Retainer".

Prior art cups are made of aluminum because the material is lightweight and rigid. Modern paints have an abrasive characteristic which wears channels or radial grooves in the atomizer ring and inside the distributor. The grooves deteriorate the performance of the cup and ultimately require cup replacement. The cups are expensive to replace because of their high precision.

Stainless steel has extremely good wear characteristics, however, its density, several times that of aluminum, makes it unsuitable to make the entire cup with this material.

Another factor that influences the wear characteristic of prior art cups is that the distributor is supported on the inside of the cup by several legs. The paint enters the center of the cup, and then passes around the inside wall of distributor to an annular series of openings. The legs supporting the distributor interrupt the flow pattern thereby creating areas with substantial wear, and paint build-up, distorting the smooth flow path of the paint.

I have found that the maximum wear occurs on the atomizer cup edge where the paint causes a chemical etching of the material.

The broad purpose of the present invention is to extend the service life of bell cups by providing a composite cup formed of different materials. The outer structure comprises an aluminum cup which forms the rear as well as a major portion of the circumference of the cup. A disk-shaped distributor is mounted in the cup. The distributor is made of a lightweight, high strength polymer which provides an improved wear resistance with respect to aluminum. A stainless steel atomizer ring is mounted along the forward edge of the cup around the distributor. The atomizer ring provides maximum toughness to minimize wear and to provide high chemical resistivity.

A stainless steel atomizer ring provides improved wear characteristics in a localized area where the maximum wear occurs in prior art cups. The weight of the stainless steel component is reduced by limiting it to a ring.

The distributor is not supported by legs to the inside of the cup but rather comprises an annular section that is seated in the cup, and a disk shaped element that is suspended by the structure between distributor channels. This eliminates any interruption of the paint flow path from where it enters the cup behind the distributor to the channels at its periphery where it passes through the distributor.

The improved bell cup is useful with modern abrasive coating materials. It provides a long wearing material in those areas that tend to wear out before the balance of the cup.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
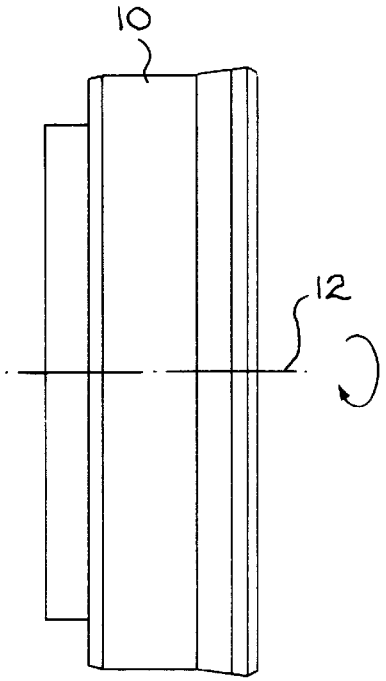
FIG. 1 is an elevational view of a bell cup illustrating the preferred embodiment of the invention.
Figure 2:
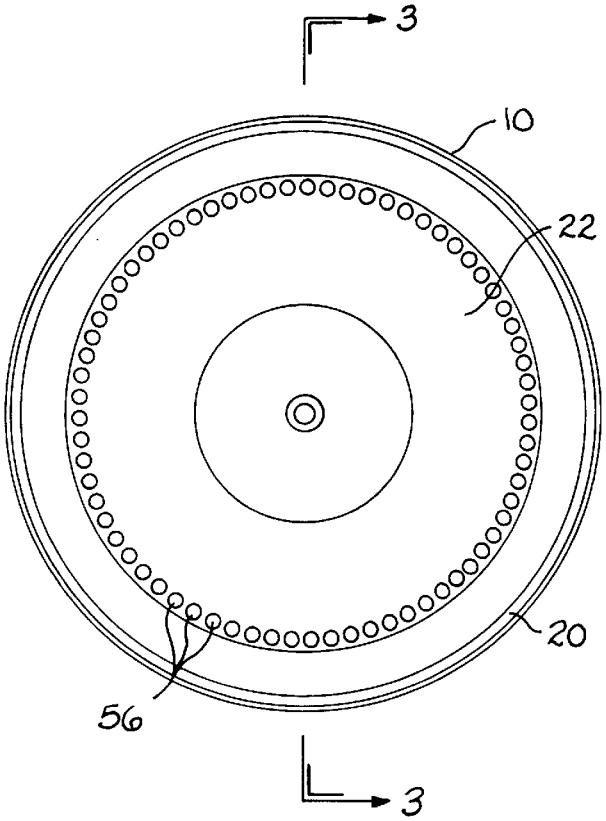
FIG. 2 is a view of the discharge end of the cup, as seen from the right side of FIG. 1.
Figure 3:
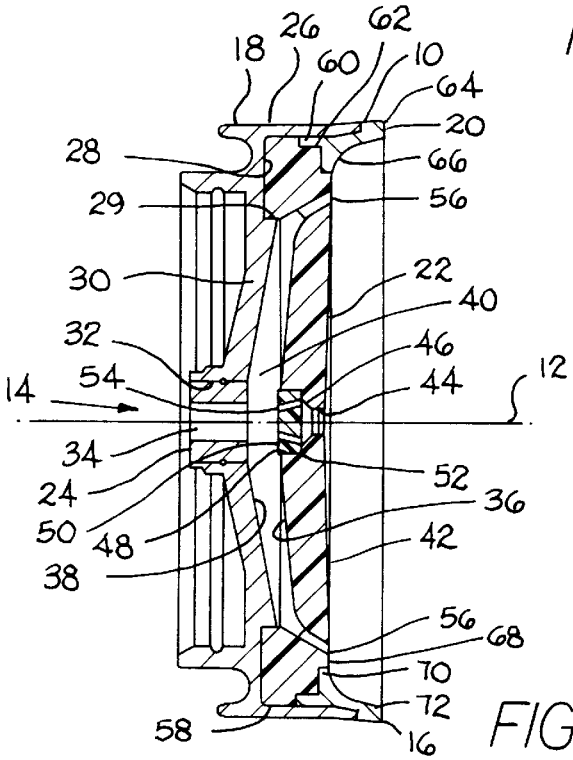
FIG. 3 is a sectional view as seen along lines 3—3 of FIG. 2.

The drawings illustrate an electrostatic atomizing bell cup 10 of the type illustrated in U.S. Pat. No. 4,936,510. The cup is rotated about a central axis 12. Coating material is delivered from a source along a path 14 to the cup interior, and atomized from the cup's front annular edge 16. The cup is employed as an electrostatic spray device for atomizing coatings on a target structure, not shown. Typical coating materials may include various types of paint, varnish and enamel.

The cup comprises a cup bottom 18, a top ring 20, a distributor 22 and a bushing 24.

The cup bottom is made of aluminum with a somewhat cylindrical wall 26 formed about a generally annular wall 28. The inner surface of wall 28 lies in a plane that is generally perpendicular to the axis of rotation 12. Wall 28 extends inwardly to a somewhat conical rear wall 30. Rear wall 30 has a central axial opening 32.

Bushing 24 is seated in opening 32. Bushing 24 has a central axial opening 34 for receiving the coating material.

The interior surface of wall 26 and the inner surface of wall 28 form an annular seat for distributor 22. The distributor is formed of a high strength polymer and comprises a ring 22A and an integral central disk 22B. The distributor disk has an inside rear somewhat conical surface 36 that is spaced from the inside surface of wall 38 to form a chamber 40 between the distributor and cup wall 30. The distributor disk has a slightly dished front wall surface 42, and a central recessed opening 44.

Opening 44 extends from surface 42 to a small internal radially enlarged section 46 which in turn terminates with a cylindrical seat 48. Seat 48 receives a smaller diffuser polymer bushing 50 which is inserted in the rear center of the distributor. Bushing 50 has four equally spaced passages 54 which diverge from chamber 40 toward the front face of the distributor and exit into section 46. Both the inlets and the outlets of passages 54 are offset from axis 12. Passages 54 are normally used to pass cleaning and flushing liquids.

The distributor has a plurality of channels 56 equally spaced in an annular array and at an angle radially outward from chamber 40. The distributor disk is supported on the distributor ring solely by the interstices between channels 56 so there is no structure interrupting the paint flow path from opening 34 to channels 56.

The cup bottom also has an inside cylindrical section 29. The distributor ring has an annular retainer area 58 that is tightly received between the inside surface of cylindrical wall 26 and wall 28.

Stainless steel top ring 20 has an outer surface that corresponds with the inside surface of cup wall 26. The outer extreme edge of the top ring tends to diverge outwardly. The top ring has an annular lip 60 that is tightly received in an annular slot 62 formed between the distributor and the inside surface of wall 26.

Ring 20 has an outer negative edge 64. It further has an annular curved surface 66 which merges smoothly with the front surface of the distributor just beyond channels 56. Ring 20 has an annular lip 68 which extends inwardly into a stepped portion 70 of the distributor.

Ring surface 66 forms a smooth continuation of the front surface of the distributor disk without disruption or any change in the flow pattern. The intent is that the combination of surface 66 and the front outer surface of the distributor will function in an equivalent manner to a one piece bell cup surface having the same contour. Surface 66 has a smooth rounded concave shape which then terminates with a frusto-conical shape 72 which in turn terminates with an outer edge which includes the negative edge.

The coating atomization process is well known. The coating material enters through bushing opening 34 and passes outwardly through channels 56.

The improved bell cup is formed with different materials that take advantage of specific properties of the materials to provide a bell cup that is lightweight, precision made, and provides optimum wear surfaces in those particular areas where modern day coatings tend to form grooves in conventional cups made entirely of aluminum.

The stainless steel atomizing ring provides minimum wear and is chemically resistant. The high strength polymer distributor is lightweight as well as wear resistant.

Having described my invention, I claim:

1. In a rotary atomizing device for spraying coating particles on to a target, comprising a cup-shaped body, having a concave opening, the body having a rear wall with a central opening for receiving coating material; a distributor member mounted in said concave opening, the distributor member having a plurality of opening means for passing the coating material through the distributor member for atomizing the coating material as the body is being rotated about an axis of rotation, and an atomizing ring disposed on said body forward of the distributor member;

the improvement comprising:

the body being formed of a first rigid material, the distributor member being formed of a second rigid material different from said first rigid material, and the atomizing ring being formed of a third rigid material, different from said first and second materials.

2. An improvement as defined in claim 1, in which the body is formed of aluminum, the distributor member is formed of a polymer, and the atomizing ring is formed of stainless steel.

3. An improvement as defined in claim 1, in which the distributor member is generally disk-shaped.

4. An improvement as defined in claim 1, in which the distributor member has an annular array of opening means around said axis of rotation for passing said coating material, said distributor member having a distributor ring seated in the cup-shaped body, and an integral disk in the path of motion of the coating particles, the disk being supported solely by the interstices between the opening means.

5. An improvement as defined in claim 1, in which the central opening in the rear wall coincides with said axis of rotation.

6. An improvement as defined in claim 4, in which the body has an internal annular shoulder for seating the distributor ring, the distributor ring being mounted in the body in abutment with said shoulder and sandwiched between the annular shoulder and the atomizing ring.

7. An improvement as defined in claim 1, in which the distributor member is mounted in the body to form a chamber between the rear wall and the distributor member for receiving coating material therein as the body is being rotated.

8. In a rotary atomizing device for spraying coating particles on to a target, comprising a cup-shaped body, having a concave opening, the body having a rear wall with a central opening for receiving coating material; a distributor member mounted in said concave opening, the distributor member having a plurality of opening means for passing the coating material through the distributor member for atomizing the coating material as the body is being rotated about as axis of rotation;

the improvement comprising:

a stainless steel ring disposed on the body forward of the distributor member and in the path of flow of the coating material exiting the opening means.

9. In a rotary atomizing device for spraying coating particles on to a target, comprising a cup-shaped body having a concave opening, the body having a rear wall with a central opening for receiving coating material; a distributor member mounted in said concave opening, the distributor member having a plurality of opening means for passing the coating material through the distributor member for atomizing the coating material as the body is being rotated about as axis of rotation;

the improvement comprising:

the distributor member comprising a ring portion seated in the body and a disk portion suspended from the ring portion solely by the interstices between the opening means whereby there are no structural interruptions to the flow of the coating material from the body central opening to the opening means in the distributor member.

* * * * *